US007034472B2

(12) United States Patent
Kobayashi et al.

(10) Patent No.: US 7,034,472 B2
(45) Date of Patent: Apr. 25, 2006

(54) POWER SUPPLY APPARATUS FOR TRAVELING-WAVE TUBE WHICH ELIMINATES HIGH VOLTAGE RELAY

(75) Inventors: Junichi Kobayashi, Kanagawa (JP); Eiji Fujiwara, Kanagawa (JP)

(73) Assignee: NEC Microwave Tube, Ltd., (JP)

( * ) Notice: Subject to any disclaimer, the term of this patent is extended or adjusted under 35 U.S.C. 154(b) by 2 days.

(21) Appl. No.: 10/951,172

(22) Filed: Sep. 27, 2004

(65) Prior Publication Data

US 2005/0067966 A1 Mar. 31, 2005

(30) Foreign Application Priority Data

Sep. 26, 2003 (JP) ..... 2003-335875

(51) Int. Cl.
*G05F 1/00* (2006.01)

(52) U.S. Cl. ..... 315/308; 315/291; 323/355

(58) Field of Classification Search ..... 315/291, 315/307, 308; 323/355; 307/132 E; 363/17
See application file for complete search history.

(56) References Cited

U.S. PATENT DOCUMENTS 5,642,268 A * 6/1997 Pratt et al. ..... 363/17
5,737,197 A * 4/1998 Krichtafovitch et al. ..... 363/17

FOREIGN PATENT DOCUMENTS

JP 11-149880 6/1999

* cited by examiner

*Primary Examiner*—Thuy Vinh Tran
*Assistant Examiner*—Tung Le
(74) *Attorney, Agent, or Firm*—Ostrolenk, Faber, Gerb & Soffen, LLP

(57) ABSTRACT

A power supply apparatus for a traveling-wave tube disclosed herein eliminates the need for isolation through a vacuum relay or the like, and is therefore fabricated in small size and at low cost. An oscillator circuit generates an oscillating signal at a frequency optionally selected from a plurality of frequencies. An inverter is applied with the oscillating signal from the oscillator circuit to generate an AC voltage signal at the frequency of the oscillating signal. A transformer transforms the AC voltage signal generated by the inverter disposed on the primary side and supplies the resulting signal to the secondary side. A rectifier circuit, which is disposed on the secondary side, rectifies the AC voltage signal transformed by the transformer for application to the traveling-wave tube. A frequency detector circuit detects the frequency of the AC voltage signal applied from the transformer to the rectifier circuit to generate a device control signal in accordance with the frequency. A control device controls the application of a voltage to an anode electrode of the traveling-wave tube in response to the device control signal.

6 Claims, 3 Drawing Sheets

POWER SUPPLY APPARATUS FOR TRAVELING-WAVE TUBE WHICH ELIMINATES HIGH VOLTAGE RELAY

BACKGROUND OF THE INVENTION

1. Field of the Invention

The present invention relates to a power supply apparatus suitable for a traveling-wave tube.

2. Description of the Related Art

A traveling-wave tube is applied with a variety of voltages such as a heater voltage, a cathode voltage, a helix voltage and a collector voltage. Also, the respective voltages are applied in accordance with a predetermined procedure called an "anode sequence" in order to prevent excessive currents. According to the anode sequence, an anode electrode must be applied with an appropriate voltage at a predetermined delay time after the application of voltages to other electrodes.

Conventionally, a circuit including a relay has been required for powering a traveling-wave tube in accordance with the anode sequence as mentioned above, and power supply apparatuses using a relay have been used in a variety of configurations (for example, see JP-11-149880-A). JP-11-149880-A shows the configuration of a conventional typical power supply apparatus for a traveling-wave tube in FIG. 3.

FIG. 1 is a block diagram illustrating an exemplary configuration of a conventional typical power supply apparatus for a traveling-wave tube. Referring to FIG. 1, the conventional power supply apparatus for a traveling-wave tube comprises high-frequency inverter 91, high-voltage transformer 92, rectifier circuit 93, anode relay 94, relay control circuit 95, and resistor 96.

High-frequency inverter 91 constitutes a primary circuit of the power supply apparatus for a traveling-wave tube. High-voltage transformer 92 transforms the output of high-frequency inverter 91 on the primary side and supplies the resulting voltage to the secondary side. Rectifier circuit 93, which exists on the secondary side, rectifiers the output of high-voltage transformer 92.

One electrode is commonly used as a cathode electrode and a positive heater electrode of traveling-wave tube 97, and is hereinafter called the "heater/cathode electrode." A negative heater electrode is simply called the "heater electrode." The output of rectifier circuit 93 is connected to the heater/cathode electrode and to heater electrode of traveling-wave tube 97, and is also connected to an anode electrode of traveling-wave tube 97 and to one terminal of anode relay 94 through resistor 96. Anode relay 94 has the other terminal connected to a helix electrode of traveling-wave tube 97 and to a ground potential, and is controlled by relay control circuit 95 to turn on and off. As relay control circuit 95 turns on anode relay 94, an anode voltage is applied, causing traveling-wave tube 97 to start an amplifying operation.

The conventional power supply apparatuses as mentioned above, however, have the following problems.

The conventional power supply apparatus for a traveling-wave tube illustrated in FIG. 1 requires relay control circuit 95 for controlling anode relay 94.

Since the potential at the anode electrode of traveling-wave tube 97 varies from approximately the ground potential to a potential at the cathode electrode which is applied with a negatively high voltage, a high-breakdown voltage relay capable of withstanding high voltages is used for anode relay 94 which is therefore operated with a high-voltage power supply. Also, a relay driving power supply (not shown) is required for driving anode relay 94. On the other hand, relay control circuit 95, which is involved in sequence control, is generally configured to operate at a low voltage.

Accordingly, isolation must be provided by a vacuum relay or the like between anode relay 94 which operates at a higher voltage and relay control circuit 95 which operates at a lower voltage, thus resulting in a larger size and a higher cost of the power supply apparatus for a traveling-wave tube.

SUMMARY OF THE INVENTION

It is an object of the present invention to provide a compact and low-cost power supply apparatus for a traveling-wave tube.

To achieve the above object, the present invention provides a power supply apparatus for a traveling-wave tube which includes an oscillator circuit, an inverter, a transformer, a rectifier circuit, a frequency detector circuit, and a control device.

The oscillator circuit generates an oscillating signal at a frequency optionally selected from a plurality of frequencies. The inverter is applied with the oscillating signal from the oscillator circuit to generate an AC voltage signal at the frequency of the oscillating signal. The transformer transforms the AC voltage signal generated by the inverter disposed on the primary side and supplies the resulting signal to the secondary side. The rectifier circuit, which is disposed on the secondary side, rectifies the AC voltage signal transformed by the transformer for application to the traveling-wave tube. The frequency detector circuit detects the frequency of the AC voltage signal applied from the transformer to the rectifier circuit to generate a device control signal in accordance with the frequency. The control device controls application of a voltage to an anode electrode of the traveling-wave tube in response to the device control signal.

The power supply apparatus may include a plurality of the frequency detector circuits, and a plurality of control devices associated with the frequency detector circuits, wherein each of the plurality of frequency detector circuits may generate the device control signal and apply the device control signal to the control device associated therewith independently of one another to control the application of the voltage to the anode electrode of associated one of a plurality of the traveling-wave tubes independently of one another.

Further, the inverter, transformer, and rectifier may make up a circuit for applying a voltage to a heater electrode of the traveling-wave tube.

The above and other objects, features, and advantages of the present invention will become apparent from the following description with reference to the accompanying drawings which illustrate examples of the present invention.

EMBODIMENTS

One embodiment of the present invention will be described in detail with reference to the accompanying drawings.

Figure 1:
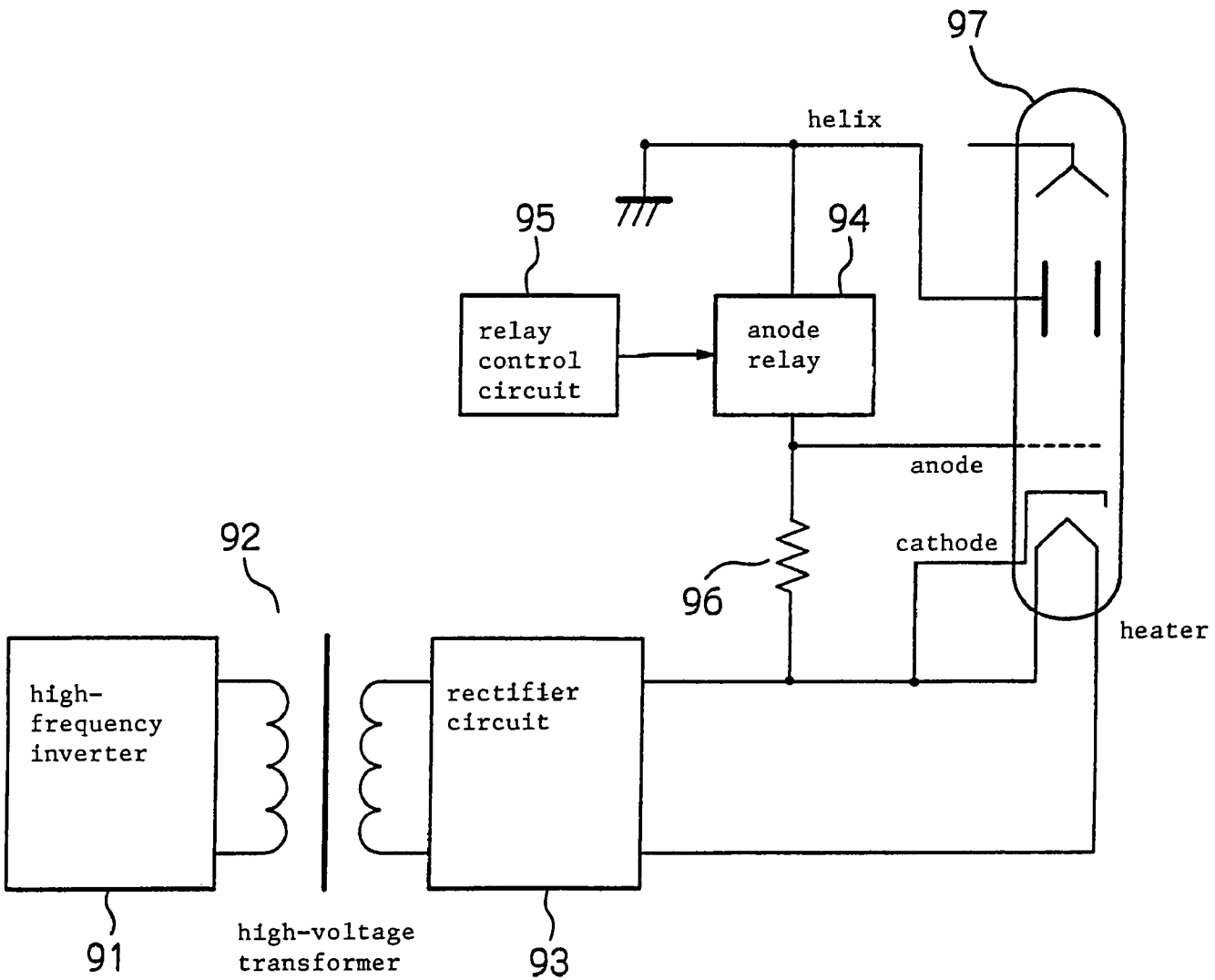
Fig. 1 (prior art)
FIG. 1 is a block diagram illustrating an exemplary configuration of a conventional typical power supply apparatus for a traveling-wave tube.
Figure 2:
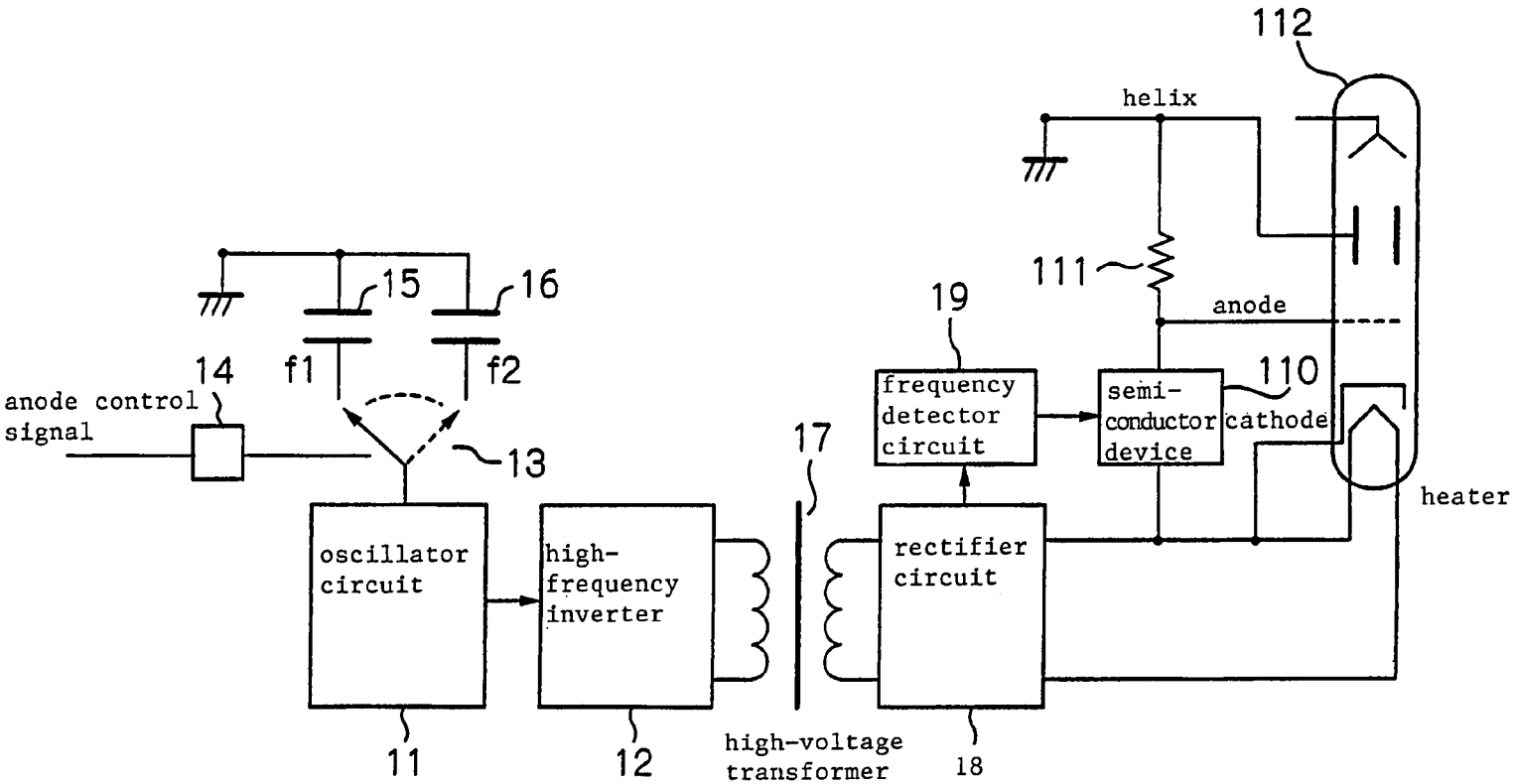
FIG. 2 is a block diagram illustrating a power supply apparatus for a traveling-wave tube according to one embodiment of the present invention.

FIG. 2 is a block diagram illustrating a power supply apparatus for a traveling-wave tube according to one embodiment of the present invention. Referring to FIG. 2, the power supply apparatus for a traveling wave tube according to this embodiment comprises oscillator circuit 11, high-frequency inverter 12, switch 13, switch control circuit 14, capacitors 15, 16, high-voltage transformer 17, rectifier circuit 18, frequency detector circuit 19, semiconductor device 110, and resistor 111.

Oscillator 11 is connected to one of capacitor 15 or capacitor 16 through switch 13. Capacitor 15 differs in capacitance from capacitor 16. Oscillator circuit 11 can select oscillating frequency f1 or f2 as switch 13 switches capacitors 15, 16 to vary the time constant. Here, f1 represents the oscillating frequency when capacitor 15 is selected, and f2 represents the oscillating frequency when capacitor 16 is selected.

Switch 13 switches the connection in accordance with an instruction from switch control circuit 14. Switch control circuit 14 in turn controls switch 13 in accordance with an anode control signal. The anode control signal is a signal for instructing switch control circuit 14 to open or close between the anode electrode and cathode electrode of traveling-wave tube 112. For example, the anode control signal is applied from an external sequence control circuit (not shown).

Switch control circuit 14 controls switch 13 to select capacitor 15 when it is instructed to close between the anode electrode and cathode electrode, and to select capacitor 16 when it is instructed to open between the anode electrode and cathode electrode. Oscillator circuit 11 generates an oscillating signal at oscillating frequency f1 when the anode control signal instructs switch control circuit 14 to close between the anode electrode and cathode electrode, and at oscillating frequency f2 when the anode control signal instructs switch control circuit 14 to open.

The oscillating signal generated by oscillator circuit 11 is applied to high-frequency inverter 12. High-frequency inverter 12 generates an AC-voltage signal at the frequency given from oscillator circuit 11. High-voltage transformer 17 transforms the output of high-frequency inverter 12 on the primary side, and supplies the resulting voltage to the secondary side. Rectifier circuit 18 exists on the secondary side, and rectifies the AC output of high-voltage transformer 17 to a DC voltage. The output of rectifier circuit 18 is connected to the cathode electrode and positive heater electrode as well as to a negative heater electrode of traveling-wave tube 112.

Semiconductor device 110, which is a control device made of semiconductor such as a transistor, by way of example, has two terminals and one control terminal. Also, semiconductor device 110 is comprised, for example, of a plurality of semiconductor devices connected in series to have a predetermined breakdown voltage. Then, semiconductor device 110 selects conduction or non-conduction between the two terminals in response to a device control signal applied to the control terminal. The output of rectifier circuit 18 is also connected to one terminal of semiconductor device 110. The other terminal of semiconductor device 110 is connected to the anode electrode of traveling-wave tube 112 and to one terminal of resistor 111. The other terminal of resistor 111 is connected to a helix electrode of traveling-wave tube 112 and to a ground potential.

Frequency detector circuit 19, which operates at a high voltage, detects the frequency of an AC voltage applied from high-voltage transformer 17 to rectifier circuit 18, and turns semiconductor device 110 on when the detected frequency is f1, and turns semiconductor device 110 off when the frequency is f2. When frequency detector circuit 19 turns semiconductor device 110 off, a potential difference is generated between the anode electrode and cathode electrode of traveling-wave tube 112 to apply a voltage to the anode electrode. This permits traveling-wave tube 112 to perform an amplifying operation.

As mentioned above, a traveling-wave tube is applied with a variety of voltages such as a heater voltage, a cathode voltage, a helix voltage and a collector voltage. The respective voltages are applied in accordance with a predetermined procedure called an "anode sequence" in order to prevent excessive currents. According to the anode sequence, the anode electrode must be applied with a voltage at a predetermined delay time after the application of the voltages to the other electrodes. This anode sequence is implemented, for example, by an external sequence control circuit (not shown).

Description will be made on the operation of the power supply apparatus for a traveling-wave tube according to this embodiment when it supplies the voltages to traveling-wave tube 112 in accordance with the anode sequence.

Initially, the anode control signal instructs switch control circuit 14 to close between the anode electrode and cathode electrode of traveling-wave tube 112. Switch control circuit 14 controls switch 13 to select capacitor 15. Oscillator 11 is set to have a time constant which results in the oscillating frequency of f1.

When the power supply apparatus is powered on in this state, high-frequency inverter 12 generates an AC voltage at frequency f1. Predetermined voltages are applied to the cathode electrode, positive heater electrode, and negative heater electrode of traveling-wave tube 112, respectively, through rectifier circuit 18. Also, since frequency detector circuit 19 detects oscillating frequency f1 to turn semiconductor device 110 on, no potential difference is generated between the anode electrode and cathode electrode. Consequently, traveling-wave tube 112 does not perform an amplifying operation in this state.

Next, after a predetermined delay time, the anode control signal instructs switch control circuit 14 to open between the anode electrode and cathode electrode of traveling-wave tube 112. Switch control circuit 14 controls switch 13 to select capacitor 16. This causes oscillator circuit 11 to oscillate at frequency f2, so that high-frequency inverter 12 generates an AC voltage at frequency f2.

The predetermined voltages are continuously applied to the cathode electrode, positive heater electrode, and negative heater electrode of traveling-wave tube 112 through rectifier circuit 18. However, since frequency detector circuit 19 detects oscillating frequency f2, semiconductor device 110 is turned off. Consequently, a potential difference is generated between the anode electrode and cathode electrode of traveling-wave tube 112 to apply an anode voltage, causing traveling-wave tube 112 to start an amplifying operation.

Thus, according to the power supply apparatus for a traveling-wave tube of this embodiment, frequency detector circuit 19 for detecting the frequency from the output of high-voltage transformer 17 can be designed to operate at a high voltage, while the sequence control circuit which operates at a low voltage can be disposed on the primary side, so that the resulting power supply apparatus for a traveling wave tube does not require isolation through a vacuum relay or the like, and can therefore be built in small size and at low cost.

Initially, no anode voltage is applied by selecting an appropriate time constant for oscillator circuit 11, causing high-frequency inverter 12 to generate an AC voltage at frequency f1, and after a predetermined delay time, a voltage can be applied to the anode electrode later than the application of voltages to the other electrodes by switching the frequency of the AC voltage generated by high-frequency inverter 12 from f1 to f2. With the foregoing procedure, the anode sequence can be realized only using voltages essentially needed by traveling-wave tube 112 without requiring an extra power supply such as a relay driving power supply, and by a circuit including a semiconductor device without using a large relay. Consequently, traveling-wave tube 112 can be powered by a small and low-cost power supply apparatus which is tolerable to vibrations and impacts. The present invention, however, is not limited to the foregoing configuration, but a high-breakdown voltage relay may be used instead of semiconductor device 110.

While the foregoing embodiment has illustrated that a single power supply circuit including high-frequency inverter 12, high-voltage transformer 17, and rectifier circuit 18 apply appropriate voltages to the helix electrode, cathode electrode, heater electrode, and anode electrode of traveling-wave tube 112, the present invention is not limited to this configuration. For example, the power supply circuit may be separated, for example, into a power supply circuit for applying voltages to the heater electrodes, and a power supply circuit for applying voltages to the other electrodes, thus providing two power supply circuits. Alternatively, a separate power supply circuit may be provided for each of the helix electrode, cathode electrode, and heater electrodes. In this configuration, the frequency of the power supply circuit for applying voltages to the heater electrodes, which require a low voltage stability, is preferably used to control semiconductor device 110. Since the anode sequence is achieved using the power supply for supplying the heater voltages which require a low voltage stability, the traveling-wave tube becomes stable in operation without affecting voltages applied to the other electrodes which require the stability for realizing the anode sequence.

Also, while the foregoing embodiment has shown an exemplary power supply apparatus which comprises resistor 111 between the helix electrode and anode electrode of traveling-wave tube 112, and semiconductor device 110 between the anode electrode and cathode electrode, the present invention is not limited to this configuration. The present invention may employ any configuration which can turn on and off a voltage applied to the anode electrode by controlling a semiconductor device. For example, a semiconductor device may be disposed between the helix electrode and anode electrode of traveling-wave tube 112, and a resistor may be disposed between the anode electrode and cathode electrode. In this case, the relationship between the semiconductor device which is turned on/off and the voltage to the anode electrode which is applied/stopped is reverse to the foregoing embodiment.

Next, description will be made on another embodiment of the present invention.

Figure 3:
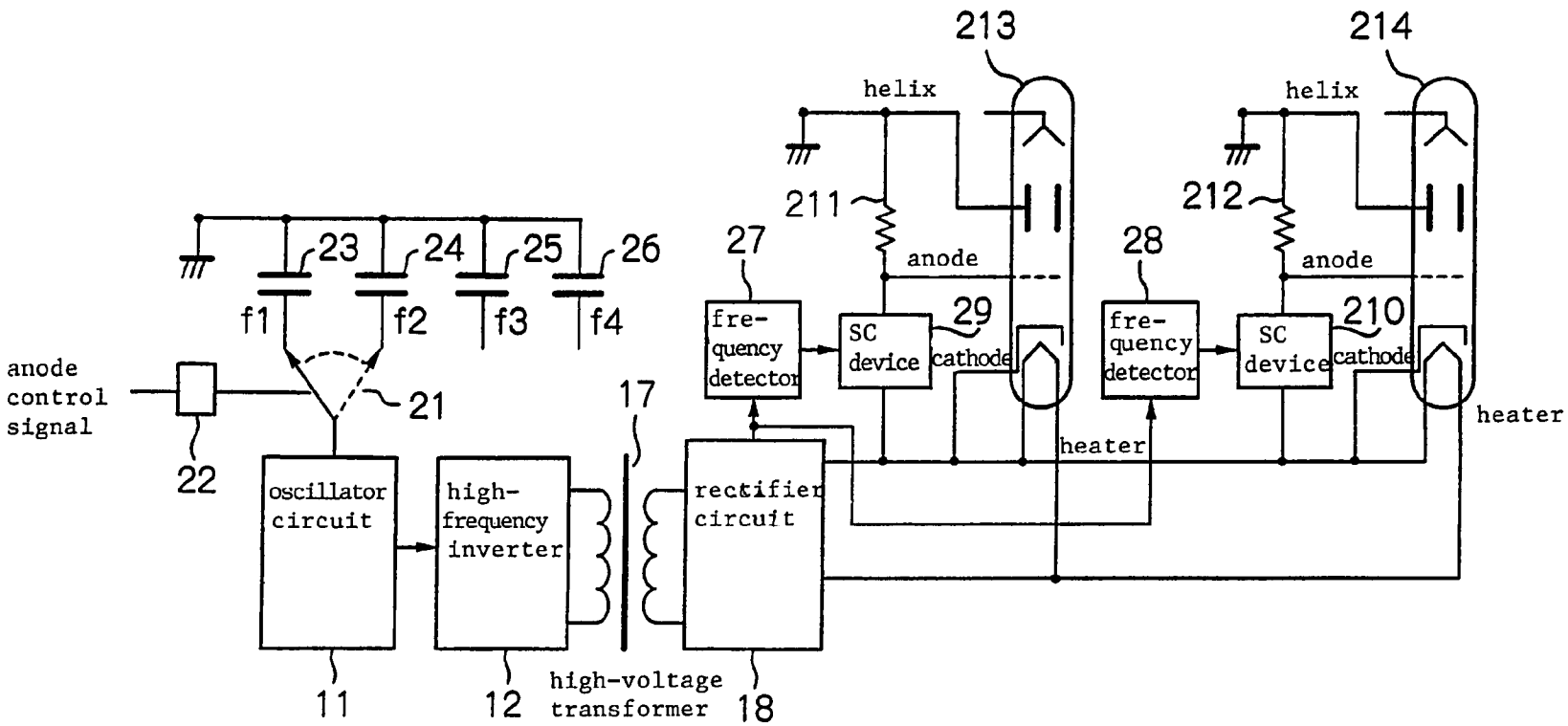
FIG. 3 is a block diagram illustrating a power supply apparatus for a traveling-wave tube according to another embodiment of the present invention.

FIG. 3 is a block diagram illustrating a power supply apparatus for a traveling-wave tube according to another embodiment of the present invention. Referring to FIG. 3, the power supply apparatus for a traveling-wave tube according to this embodiment comprises oscillator circuit 11, high-frequency inverter 12, switch 21, switch control circuit 22, capacitors 23, 24, 25, 26, high-voltage transformer 17, rectifier circuit 18, frequency detector circuits 27, 28, semiconductor devices 29, 210, and resistors 211, 212.

Oscillator circuit 11 is connected to one of capacitors 23–26 through switch 21. Capacitors 23–26 have capacitances different from one another. Oscillator circuit 11 can select oscillating frequency f1–f4 as switch 21 switches capacitors 23–26 to vary the time constant. Here, f1 represents the oscillating frequency when capacitor 23 is selected; f2, when capacitor 24 is selected; f3, when capacitor 25 is selected; and f4, when capacitor 26 is selected.

Switch 21 switches the connection in accordance with an instruction from switch control circuit 22. Switch control circuit 22 in turn controls switch 21 in accordance with an anode control signal. The anode control signal is a signal for instructing switch control circuit 22 to open or close between an anode electrode and a cathode electrode of each of traveling-wave tubes 213, 214.

Switch control circuit 22 selects capacitor 23 when it is instructed to close between the anode electrode and cathode electrode of both traveling-wave tubes 213, 214. Also, switch control circuit 22 selects capacitor 24 when it is instructed to close between the anode electrode and cathode electrode of traveling-wave tube 213 and to open between the anode electrode and cathode electrode of traveling-wave tube 214. Also, switch control circuit 22 selects capacitor 25 when it is instructed to open between the anode electrode and cathode electrode of traveling wave tube 213 and to close the anode electrode and cathode electrode of traveling-wave tube 214. Switch control circuit 22 selects capacitor 26 when it is instructed to open between the anode electrode and cathode electrode of both traveling-wave tubes 213, 214.

An oscillating signal generated by oscillator circuit 11 is applied to high-frequency inverter 12. High frequency inverter 12 generates an AC voltage signal at a frequency given from oscillator circuit 11. High-voltage transformer 17 transforms the output of high-frequency inverter 12 on the primary side, and supplies the resulting voltage to the secondary side. Rectifier circuit 18 exists on the secondary side, and rectifies the AC output of high-voltage transformer 17 to a DC voltage. The output of rectifier circuit 18 is connected to cathode electrodes and positive heater electrodes as well as to negative heater electrodes of traveling-wave tubes 213, 214.

Each of semiconductor devices 29, 210, which is a control device made of semiconductor, such as a transistor, by way of example, has two terminals and one control terminal. Then, in accordance with a device control signal applied to the control terminal, each of semiconductor devices 29, 210 selects conduction or non-conduction between the two other terminals. The output of rectifier circuit 18 is also connected to one terminal of each of semiconductor devices 29, 210.

Semiconductor device 29 has the other terminal connected to the anode electrode of traveling-wave tube 213 and to one terminal of resistor 211. The other terminal of resistor 211 is connected to the helix electrode of traveling-wave tube 213 and to a ground potential. Similarly, semiconductor device 210 has the other terminal connected to the anode electrode of traveling-wave tube 24 and to one terminal of resistor 212. The other terminal of resistor 212 is connected to the helix electrode of traveling-wave tube 214 and to the ground potential.

Frequency detector circuit 27 detects the frequency of the AC voltage applied from high-voltage transformer 17 to rectifier circuit 18 to turn semiconductor device 29 on when the frequency is f1 or f3, and to turn semiconductor device 29 off when the frequency is f2 or f4. When frequency detector circuit 27 turns semiconductor device 29 off, a potential difference is generated between the anode electrode and cathode electrode of traveling-wave tube 213 to apply a voltage to the anode electrode. This permits traveling-wave tube 213 to perform an amplifying operation.

Similarly, frequency detector circuit 28 detects the frequency of the AC voltage applied from high-voltage transformer 17 to rectifier circuit 18 to turn semiconductor device 210 on when the frequency is f1 or f2 and to turn semiconductor device 210 off when the frequency is f3 or f4. When the frequency detector circuit 28 turns semiconductor device 210 off, a potential difference is generated between the anode electrode and cathode electrode of traveling-wave tube 214 to apply a voltage to the anode electrode. This permits traveling-wave tube 214 to perform an amplifying operation.

While the foregoing embodiment has illustrated an example in which two traveling-wave tubes 213, 214 are controlled arbitrarily in their amplifying operation, the anode sequence and amplifying operation of a plurality of traveling-wave tubes can be arbitrarily controlled by increasing the number of selectable frequencies. For example, the present invention can be applied to a system which uses a phased array antenna that includes a plurality of antenna elements.

As will be appreciated from the foregoing, according to the power supply apparatus for a traveling-wave tube of the foregoing embodiment, the amplifying operation of a plurality of traveling-wave tubes 213, 214 can be arbitrarily started and stopped by a compact and low-cost circuit which selects one of frequencies f1–f4 for high-frequency inverter 12. For example, for first starting the amplifying operation of traveling-wave tube 213, next starting the amplifying operation of traveling-wave tube 214, and then stopping the amplifying operation of traveling-wave tube 213, the frequency of high-frequency inverter 12 may be switched in order of f1, f3, f4, f2.

While preferred embodiments of the present invention have been described using specific terms, such description is for illustrative purposes only, and it is to be understood that changes and variations may be made without departing from the spirit or scope of the following claims.

What is claimed is:

1. A power supply apparatus for a traveling-wave tube for controlling application of voltages to said traveling-wave tube, comprising:

an oscillator circuit for generating an oscillating signal at a frequency optionally selected from a plurality of frequencies;

an inverter applied with the oscillating signal from said oscillator circuit to generate an AC voltage signal at the frequency of the oscillating signal;

a transformer for transforming the AC voltage signal generated by said inverter disposed on a primary side to supply the resulting signal to a secondary side;

a rectifier circuit disposed on the secondary side of said transformer for rectifying the AC voltage signal transformed by said transformer into a DC signal for application to said traveling-wave tube;

a frequency detector circuit for detecting the frequency of the AC voltage signal applied from said transformer to said rectifier circuit to generate a device control signal for controlling the application of a voltage to an anode electrode of said traveling-wave tube in accordance with the frequency; and a control device for controlling the application of the voltage to the anode electrode of said traveling-wave tube in response to the device control signal.

2. The power supply apparatus for a traveling-wave tube according to claim 1, comprising a plurality of said frequency detector circuits, and a plurality of control devices associated with said frequency detector circuits, wherein each of said plurality of frequency detector circuit generates the device control signal and applies the device control signal to said control device associated therewith independently of one another to control the application of the voltage to the anode electrode of an associated one of a plurality of traveling-wave tubes independently of one another.

3. The power supply apparatus for a traveling-wave tube according to claim 1, wherein said inverter, said transformer, and said rectifier comprise a circuit for applying a voltage to a heater electrode of said traveling-wave tube.

4. The power supply apparatus for a traveling-wave tube according to claim 1, further comprising a plurality of capacitors having different capacitances, wherein said oscillator circuit is connected to one of said capacitors to change the frequency of the oscillating signal in accordance with the capacitance of the one capacitor connected thereto.

5. The power supply apparatus for a traveling-wave tube according to claim 1, wherein said control device is a device made of semiconductor.

6. The power supply apparatus for a traveling-wave tube according to claim 1, wherein said control device comprises a relay.

* * * * *